US006638708B1

(12) United States Patent
Ghyzel et al.

(10) Patent No.: US 6,638,708 B1
(45) Date of Patent: Oct. 28, 2003

(54) SILVER (CARBOXYLATE-N-ALKYL THIOLATE) PARTICLES FOR PHOTOTHERMOGRAPHIC OF THERMOGRAPHIC IMAGING

(75) Inventors: Peter J. Ghyzel, Rochester, NY (US); Mark Lelental, Rochester, NY (US); David A. Dickinson, Brockport, NY (US); Alan R. Pitt, Herts (GB); Trevor J. Wear, Harrow Middlesex (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/200,417

(22) Filed: Jul. 22, 2002

(51) Int. Cl.[7] ..... G03C 1/498

(52) U.S. Cl. ..... 430/619; 430/611; 430/620; 430/631

(58) Field of Search ..... 430/619, 620, 430/611, 631

(56) References Cited

U.S. PATENT DOCUMENTS 3,666,477 A 5/1972 Goffe et al.

6,391,537 B2 * 5/2002 Lelental et al. ..... 430/620

FOREIGN PATENT DOCUMENTS

EP 0803764 A1 6/2001

OTHER PUBLICATIONS

R. Voicu; A. Badia; F. Morin. R. B. Lennox; T.H. Ellis; Thermal Behavior of a Self–Assembled Silver n–Dodecanethiolate Layered Material Monitored by DSC; pp. 2642–2652.

R. Voicu; A. Badia; F. Morin; R.B. Lennox; T.H. Ellis; Structure and Dynamics of Selectively Deuterated Self–Assembled Silver n–Octadecanethiolate Layered Materials; pp. 2266–2271.

* cited by examiner

*Primary Examiner*—Thorl Chea
(74) *Attorney, Agent, or Firm*—J. Jeffrey Hawley

(57) ABSTRACT

The present disclosure relates to dispersions of silver (carboxylate-n-alkyl thiolate). The carboxylates are typically silver salts of long chain fatty acids and the n-alkyl thiolate is preferably 1-dodecanethiol. These silver (carboxylate-n-alkyl thiolate) particles can be used to formulate imaging forming compositions that are useful in aqueous thermographic or photothermographic imaging elements.

16 Claims, No Drawings

SILVER (CARBOXYLATE-N-ALKYL THIOLATE) PARTICLES FOR PHOTOTHERMOGRAPHIC OF THERMOGRAPHIC IMAGING

FIELD OF INVENTION

This invention relates to dispersions of silver (carboxylate-n-alkyl thiolate) particles. The carboxylates are typically silver salts of long chain fatty acids and the thiolates are compounds that function as antifoggant compounds. These silver (carboxylate-n-alkyl thiolate) particles can be used to formulate imaging forming compositions that are useful in photothermographic or thermographic imaging elements.

DESCRIPTION RELATIVE TO PRIOR ART

Thermographic and photothermographic materials and imaging elements are well known in the photographic art. These materials are also known as heat developable photographic materials. Thermographic materials can form an image by the imagewise application of heat. Photothermographic materials include a light sensitive material, for example a silver halide. After imagewise exposure photothermographic materials are heated to moderately elevated temperatures to produce a developed image in the absence of separate processing solutions or baths.

An example of a known photothermographic silver halide material comprises (a) a hydrophilic photosensitive silver halide emulsion containing a gelatino peptizer with (b) an organic solvent mixture, (c) a hydrophobic binder and (d) an oxidation-reduction image-forming composition. The oxidation-reduction imaging forming composition typically comprises (i) a silver carboxylate that is usually a silver salt of a long-chain fatty acid, such as silver behenate or silver stearate, in combination with (ii) an organic reducing agent, such as a phenolic reducing agent. It has been desirable to have hydrophilic photosensitive silver halide emulsion containing a gelatino peptizer in such a photothermographic material because of the higher photosensitivity of the silver halide emulsion and the ease of control in preparation of the emulsion based on conventional aqueous silver halide gelatino emulsion technology.

A problem has been encountered in preparing these photothermographic silver halide materials. This problem involves the mixing of a hydrophilic photosensitive silver halide emulsion containing a gelatino peptizer with an oxidation-reduction imaging forming composition. The imaging forming composition contains hydrophobic components including a hydrophobic binder, such as poly(vinyl butyral), and a silver salt of a long-chain fatty acid, such as a silver salt of behenic acid. Typically, when the hydrophilic photosensitive silver halide emulsion is mixed with the hydrophobic imaging forming materials and then coated on a suitable support to produce a photothermographic element, the resulting element produces a less than desired degree of photosensitivity, contrast and maximum density upon exposure and heat processing. This problem has been encountered in photothermographic silver halide materials, as described in, for example, U.S. Pat. No. 3,666,477 of Goffe, issued May 30, 1972. Goffe proposed addition of alkylene oxide polymers and a mercaptotetrazole derivative to the photothermographic material to help provide increased photosensitivity. In addition, a variety of organic solvents have been proposed in order to help prepare a photothermographic silver halide composition containing the described image-forming components. The organic solvents that have been proposed include isopropanol, acetone, toluene, methanol, 2-methoxyethanol, chlorinated solvents, acetone-toluene mixtures and certain non-aqueous polar organic solvents. The described individual solvents, such as isopropanol, have not provided the desired improved properties. There has been a continuing need to provide improved relative speed and contrast with the desired maximum image density while minimizing fog formation.

Recent developments have focused on providing imaging compositions, for example photothermographic compositions, that are aqueous based. Such compositions, compared to organic solvent-based compositions, have numerous coating advantages. For example, expensive organic solvent recovery systems are not necessary in the coating process.

It is known in the prior art (for example Katoh EP 0 803 764 A1) that mercapto (or thiol), disulfide and thion compounds may be added for the purposes of retarding or accelerating development, controlling development, improving spectral sensitization efficiency, and improving storage stability before and after development. Preferred compounds have structures represented by Ar—SM and Ar—S—S—Ar wherein M is a hydrogen atom or alkali metal atom, and Ar is an aromatic ring or fused aromatic ring having at least one nitrogen, sulfur, oxygen, selenium or tellurium atom.

Besides being expensive, the above mentioned compounds are in general hydrophobic solids. This means that they require special techniques such as media milling to prepare dispersions that are compatible with aqueous photothermographic elements. Simpler mercapto compounds that are less expensive, are water soluble but have the distinct disadvantage of having the characteristic 'rotten egg' smell of mercaptans. Non water soluble liquid mercaptans have the further disadvantage of tending to destabilize the colloids typically used to prepare aqueous photothermographic elements.

It is thus desirable to have a photothermographic compostions that incorporate mercaptans while avoiding the above mentioned expense and difficulty. It is particularly desirable to provide these compositions in an aqueous medium so that they can be conveniently coated.

SUMMARY OF THE INVENTION

In one aspect of the invention, there is provided a dispersion of silver-carboxylate particles having incorporated therein an n-alkyl thiolate compound. The invention can provide an aqueous nanoparticulate dispersions of silver (carboxylate-n-alkyl thiolate) particles that provide desired silver development kinetics and image density, while maintaining low fog. The invention also provides elements with superior keeping performance.

As noted, a characteristic of the present invention is that the silver-carboxylate particles have an n-alkyl thiolate compound incorporated into the structure of the particles. Being incorporated into the particle means that the n-alkyl thiolate is not free but rather is part of the particle in the same sense, for example, as would be a dopant. One of the characteristics of such a particle is that the x-ray diffraction pattern resembles the pattern obtained from the silver-carboxylate. In contrast, if silver carboxylate particles are simply mixed with silver-thiolate particles, a second novel crystallographic phase would be observed in the x-ray diffraction pattern of the mixture. These particles will be referred to as "silver (carboxylate-n-alkyl thiolate) particles".

As will be seen from the comparative examples, it is important that the thiolates be n-alkyl thiolates. Similar compositions, except using tertiary-alkyl thiolates, do not produce the same desirable results. Similarly, it is important that the n-alkyl thiolate be incorporated in the particles. As the comparative examples show, simply mixing the n-alkyl thiolate with silver (carboxylate) particles does not produce the desired result.

In preferred embodiments of the invention, the silver (carboxylate-n-alkyl thiolate) particles incorporated into the aqueous or non aqueous composition exhibit nanoparticulate morphology. It is particularly preferred that at least a portion of the non-photosensitive source of reducible silver ions be provided in the form of a nanoparticulate dispersion of silver (carboxylate-n-alkyl thiolate) particles. By nanoparticulate, we mean that the silver (carboxylate-n-alkyl thiolate) particles in such dispersions preferably have a weight average particle size of less than 1000 nm when measured by any useful technique such as sedimentation field flow fractionation, photon correlation spectroscopy, or disk centrifugation. In one particular method of measuring particle size and its distribution is determined using a Horiba LA-920, He—Ne, laser particle size analyzer. This analyzer measures the particle size distribution by angular light scattering technique. Obtaining such small silver (carboxylate-n-alkyl thiolate) particles can be achieved using a variety of techniques described in the copending applications identified in the following paragraphs, but generally they are achieved using high speed milling using a device such as those manufactured by Morehouse-Cowles and Hochmeyer. The details for such milling are well known in the art.

Another aspect of the invention provides an oxidation-reduction imaging forming composition comprising (i) a nanoparticulate dispersion of silver (carboxylate-n-alkyl thiolate) particles and (ii) an organic reducing agent. The described thermographic composition can be coated on a support to provide a useful thermographic element.

In another aspect of the invention, there is provided a photothermographic composition comprising a) a photosensitive silver halide emulsion containing a gelatino peptizer and b) an oxidation-reduction imaging forming composition comprising (i) a nanoparticulate dispersion of silver (carboxylate-n-alkyl thiolate) particles and (ii) an organic reducing agent. The described photothermographic composition can be coated on a support to provide a useful photothermographic element.

In another aspect, there is provided an oxidation-reduction imaging forming composition comprising (i) a dispersion silver (carboxylate-n-alkyl thiolate) particles said particles having on the surface of the particles a surface modifier which is a nonionic oligomeric surfactant based on vinyl polymer with an amido function and (ii) an organic reducing agent. This composition can be coated on a support to provide a useful thermographic element.

In another aspect, there is provided a photothermographic composition comprising a) an infrared spectrally sensitized photosensitive silver halide emulsion containing a gelatino peptizer and b) an oxidation-reduction imaging forming composition comprising (i) a dispersion of silver (carboxylate-n-alkyl thiolate) particles said particles having on the surface of the particles a surface modifier which is a nonionic oligomeric surfactant based on a vinyl polymer with an amido function and (ii) an organic reducing agent. The described photothermographic composition can be coated on a support to provide a useful photothermographic element.

DETAILED DESCRIPTION OF THE INVENTION

This invention solves, or greatly minimizes the prior art problems referred to above. A process is provided that produces silver (carboxylate-n-alkyl thiolate) particle dispersions, preferably in aqueous medium. The imaging elements comprising silver (carboxylate-n-alkyl thiolate) particles exhibit reduced photographic fog and superior raw stock keeping characteristics in comparison to the elements formulated only with silver (carboxylate). The images produced using photothermographic elements of this invention exhibit low turbidity and low photographic fog. In the preferred nanoparticulate form, the silver (carboxylate-n-alkyl thiolate) particle dispersions are easy to filter and display excellent shelf life. These dispersions have been successfully incorporated with the other necessary ingredients into an aqueous photothermographic imaging element and successfully exposed and thermally processed using a laser printer and thermal processor.

The particles in such dispersions can be stabilized by having on their surface a surface modifier so the silver salt can more readily be incorporated into aqueous-based photothermographic formulations. Useful surface modifiers include, but are not limited to, nonionic oligomeric surfactants based on vinyl polymers having an amino function, such as polymers prepared from acrylamide, methacrylamide, or derivatives thereof, as described in commonly assigned POLYACRYLAMIDE SURFACE MODIFIERS FOR SILVER CARBOXYLATE NANOPARTICLES, Lelental, Pitt, Dickinson, Wakley and Ghyzel, U.S. Pat. No. 6,391,537. A particularly useful surface modifier is dodecylthiopolyacrylamide that can be prepared as described in the noted copending application using the teaching provided by Pavia et al., Makromolecular Chemie, 193(9), 1992, pp. 2505–17.

Other useful surface modifiers are phosphoric acid esters, such as mixtures of mono- and diesters of orthophosphoric acid and hydroxy-terminated, oxyethylated long-chain alcohols or oxyethylated alkyl phenols as described for example in PHOSPHORIC ACID ESTER SURFACE MODIFIERS FOR SILVER CARBOXYLATE NANOPARTICLES, Lelental, Dickinson, Wakley, Orem and Ghyzel, U.S. Pat. No. 6,387,611. Particularly useful phosphoric acid esters are commercially available from several manufacturers under the trademarks or tradenames EMPHOSTM (Witco Corp.), RHODAFAC (Rhone-Poulenc), T-MULZ® (Hacros Organics), and TRYFAC (Henkel Corp./Emery Group).

Such dispersions contain smaller particles and narrower particle size distributions than dispersions that lack such surface modifiers. Particularly useful nanoparticulate dispersions are those comprising silver carboxylates such as silver salts of long chain fatty acids having from 8 to 30 carbon atoms, including, but not limited to, silver behenate, silver caprate, silver hydroxystearate, silver myristate, silver palmitate, and mixtures thereof. Silver behenate nanoparticulate dispersions are most preferred. These nanoparticulate dispersions can be used in combination with the conventional silver salts described above, including but not limited to, silver benzotriazole, silver imidazole, and silver benzoate. In another aspect of the invention, there is provided an aqueous oxidation-reduction imaging forming composition comprising (i) a dispersion of silver (carboxylate-azine toner) particles as described having on the surface of the particles a surface modifier which is a nonionic oligomeric surfactant based on vinyl polymer with an amido function and (ii) an organic reducing agent.

In the case of controlled coprecipitation of metal salts or complexes such as water insoluble silver (carboxylate-n-alkyl thiolate) particles, the surface modifiers offer higher degree of particle size reduction, an improved colloidal stability of the dispersed system, higher chemical reactivity and lower low-shear viscosity. The nanoparticulate silver (carboxylate-n-alkyl thiolate) particles increase the reactivity of the silver metal-forming oxidation-reduction photothermographic development chemistry and hence, a lower temperature and (or) shorter development time is required to generate final silver image and to maximize image discrimination. Furthermore, the use of nanoparticulate silver (carboxylate-n-alkyl thiolate) particles in the film microstructure provides for a significant reduction of the film turbidity generally attributed to the particle size controlled light scattering improved image density and neutral image tone.

The present invention relates to a dispersion of silver (carboxylate-n-alkyl thiolate) particles. Particularly preferred silver (carboxylates) are silver salts of long chain fatty acids such as, for example, silver stearate, silver behenate, silver caprate, silver hydroxystearate, silver myristate and silver palmitate. The preferred thiols are n-alkyl thiolates having alkyl chains of 2 to 24 carbons with the most preferred thiolates having alkyl chains of 6 to 18 carbons. Examples include but are not limited to silver 1-hexanethiolate, silver 1-dodecanethiolate, and silver 1-octadecanethiolate. N-Alkyl thiolates are a known class of compounds that have been extensively studied. Reference is made to: Structure and Dynamics of Selectively Deuterated Self-Assembled Silver n-Octadecanethiolate Layerd Materials, Voicu et al, Chem. Mater. 2001, 13, 2266–2271; and Thermal Behavior of a Self-Assembled Silver n-Dodecanethiolate Layered Material Monitored by DSC, FTIR, and $^{13}$C NMR Spectroscopy, Voicu, Chem Mater. 2000, 12, 2646–2652. The particles preferably contain n-alkyl thiolate from about 0.01 to 10% by weight of the particles.

One preferred silver source is a silver (carboxylate-azine toner) particle. Particles containing large amounts of the azine toner are described in U.S. Pat. No. 5,350,669 to Whitcomb et al, issued Sep. 27, 1994. Advantageous silver (carboxlyate-azine toner) particles having only a small amount of incorporated azine toner are described in copending, commonly assigned U.S. Ser. No. 10/200,426 filed on the same date as this application for Lelental, Ghyzel, Boettcher, Wakley, Dickinson, Maskasky, Klaus, Scaccia and Blanton. The azine toner content of these silver (carboxylate-azine toner) particles is from about 0.01 to 10% by weight relative to silver carboxylate, preferably about 0.05 to 5%.

The use of nonsilver (carboxylate-azine toner) toners/development accelerators or derivatives thereof which improve the image density and tone, is highly desirable to the element. Toners may be present in amounts of from 0.01 to 20 percent by weight of the emulsion layer, preferably from 0.1 to 10 percent by weight. In addition to the toner that is present in the silver (carboxylate-azine toner) particles, additional toner may be present. These other toners can be present to provide enhanced chemical reactivity and to adjust tone as desired. For sensitized materials, toners should be chosen that do not desensitize the spectrally sensitized silver halide. Toners are well known materials in the photothermographic art as shown in U.S. Pat. Nos. 3,080,254; 3,847,612 and 4,123,282. Examples of useful toners include phthalimide and N-hydroxyphthalimide; cyclic imides such as succinimide, pyrazoline-5-ones, and a quinazolinone, 1-phenylurazole, 3-phenyl-2-pyrazoline-5-one, quinazoline and 2,4-thiazo lidinedione; naphthalimides such as N-hydroxy-1,8-naphthalimide; cobalt complexes such as cobaltic hexaminetrifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, e.g.(N,N-dimethylaminomethyl)phthalimide, and N-(dimethylaminomethyl)naphthalene-2,3-dicarboximide, and a combination of blocked pyrazoles, isothiuronium derivatives and certain photobleach agents, e.g., a combination of N,N'-hexamethylene-bis(1-carbamoyl-3,5-dimethylpyrazole), 1,8-(3,6-diazaoctane)bis(isothiuronium) trifluoroacetate and 2-(tribromomethylsulfonyl benzothiazole); and merocyanine dyes such as 3-ethyl-5-[(3-ethyl-2-benzothiazolinylidene)-1-methylethylidene]-2-thio-2,4-oazolidinedione; phthalazinone, phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazine plus one or more phthalic acid derivatives, e.g., phthalic acid, 4-methylphthalic acid, 4-nitrophthalic acid, and tetrachlorophthalic arthydride; quinazolinediones, benzoxazine or naphthoxazine derivatives; rhodium complexes ▩g, ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asymtriazines, e.g., 2,4-dihydroxypyrimidine, 2-hydroxy-4-aminopyrimidine, and azauracil, and tetrazapentalene derivatives, e.g., 3,6-dimercapto-1,4-diphenyl-1H,4H-2,3a,5,6a-tetrazapentalene, and 1,4-di(o-chlorophenyl)-3,6-dimercapto-1H,4H-2,3 a,5,6a-tetrazapentalene.

A number of surface modifiers can be used to facilitate the formation of nanoparticulate silver (carboxylate-azine) particles. Particular examples are disclosed in the following U.S. Pat. Nos. 6,391,537 and 6,387,611 POLYACRYLAMIDE SURFACE MODIFIERS FOR SILVER CARBOXYLATE NANOPARTICLES, Lelental, Pitt, Dickinson, Wakley and Ghyzel, cited above; and PHOSPHORIC ACID ESTER SURFACE MODIFIERS FOR SILVER CARBOXYLATE NANOPARTICLES, Lelental, Dickinson, Wakley, Orem and Ghyzel also cited above.

The preferred surface modifiers are polyacrylamide modifiers that are broadly defined by either of the following formulas:

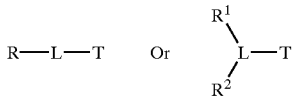

The number of hydrophobic groups (R or R1 & R2) depends on the linking group L. The hydrophobic group or groups comprise a saturated or unsaturated alkyl, aryl-alkyl or alkyl-aryl group where the alkyl parts can be straight or branched. Typically the groups R or R1 & R2 comprise 8–21 carbon atoms. The linking group L is linked to the hydrophobic groups by a simple chemical link and to the oligomeric part T by a thio link (—S—).

Typical linking groups for materials with one hydrophobic group are illustrated as follows:

(a)

(b)

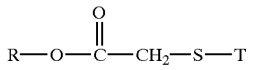

(c)

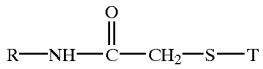

Typical linking groups for materials with two hydrophobic groups are illustrated as follows:

(d)

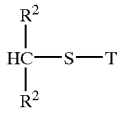

(e)

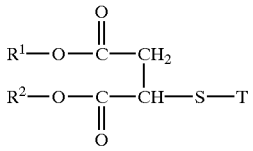

(f)

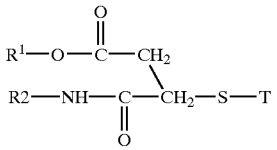

The oligomeric group T is based on the oligomerisation of vinyl monomers with an amido function, the vinyl part providing the route to oligomerisation and the amido part providing a nonionic polar group to constitute the hydrophilic functional group (after oligomerisation). The oligomeric group T can be made up from a single monomer source or a mixture of monomers provided the resulting oligomeric chain is sufficiently hydrophilic to render the resulting surface active material soluble or dispersible in water. Typical monomers used to create the oligomeric chain T are based on acrylamide, methacrylamide, derivatives of acrylamide, derivatives of methacrylamide and 2-vinylpyrollidone, though the latter is less favored due to adverse photographic effects sometimes found with polyvinyl pyrrolidone (PVP).

These monomers can be represented by two general formulas:

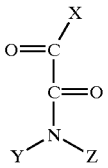

Acrylamide
Methacrylamide or
derivatives thereof

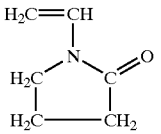

2-vinylpyrrolidone

X is typically H or CH3, which leads to an acrylamide or methacrylamide based monomer respectively.

Y and Z' are typically H, CH3, C2H5, C(CH2OH)3 where X and Y can be different or the same.

The described oligomeric surfactant based on vinyl polymer with an amido function can be made by methods that are known in the art or are simple modifications of known methods.

Nanoparticulate silver (carboxylate-n-alkyl thiolate) particle dispersions can be prepared by a precipitation process commonly used for the precipitation of photographic silver halide emulsions. Into a conventional reaction vessel for silver precipitation equipped efficient stirring mechanism is introduced a surface modifier. Typically the surface modifier initially introduced into the reaction vessel is at least about 5 percent, preferably 10 to 30 percent, by weight based on total weight of the surface modifier present in the nanoparticulate silver (carboxylate-n-alkyl thiolate) dispersion the conclusion of grain precipitation. Since surface modifier can be removed from the reaction vessel by ultrafiltration during silver (carboxylate-n-alkyl thiolate) particle dispersion precipitation, as taught by Mignot U.S. Pat. No. 4,334,012, it is appreciated that the volume of surface modifier initially present in the reaction vessel can equal or even exceed the volume of the silver-carboxylate, silver-azine toner particles present in the reaction vessel at the conclusion of grain precipitation. The surface modifier initially introduced into the reaction vessel is preferably aqueous solution or an aqueous dispersion of surface modifier, optionally containing other ingredients, such as one or more antifoggant and/or various dopants, more specifically described below. Where a surface modifier is initially present, it is preferably employed in a concentration of at least 5 percent, most preferably at least 10 percent, of the total surface modifier present at the completion of silver (carboxylate-n-alkyl thiolate) particle dispersion precipitation. Additional surface modifier can be added to the reaction vessel with the water-soluble silver salts and can also be introduced through a separate jet.

During precipitation silver, carboxylate salts and thiol compound(s) are added to the reaction vessel by techniques well known in the precipitation of photographic silver halide grains. The carboxylate salts are typically introduced as aqueous salt solutions, such as aqueous solutions of one or more soluble ammonium, alkali metal (e.g., sodium or potassium), or alkaline earth metal (e.g., magnesium or calcium) carboxylate salts.

With the introduction of silver salt into the reaction vessel the nucleation stage of silver (carboxylate-n-alkyl thiolate) grain(s) formation is initiated. A population of grain nuclei is formed which is capable of serving as precipitation sites for silver (carboxylate-n-alkyl thiolate) as the introduction of silver and (or) carboxylic acid salts and (or) thiol compound(s) continues. The precipitation of silver (carboxylate-n-alkyl thiolate) onto existing grain nuclei constitutes the growth stage of nanoparticulate grain formation.

The concentrations and rates of silver, thiol compound(s) and carboxylic acid salt introductions can take any convenient conventional form. Specifically preferred precipitation techniques are those which achieve shortened precipitation times by increasing the rate of silver, thiol compound(s) and carboxylic acid salt introduction during the run. The rate of silver, thiol compound(s) and or carboxylic acid salt introduction can be increased either by increasing the rate at which the silver and or carboxylic acid salts are introduced or by increasing the concentrations of the silver, thiol compound(s) and carboxylic acid salts within the solution.

The individual silver and (or) thiol compound(s) carboxylic acid salts can be added to the reaction vessel through surface or subsurface delivery tubes by gravity feed or by delivery apparatus for maintaining control of the rate of delivery and the pH, and/or pAg of the reaction vessel contents, as illustrated by Culhane et al. U.S. Pat. No. 3,821,002, Oliver U.S. Pat. No. 3,031,304 and Claes et al., Photographische Korrespondenz, Band 102, Nov. 10, 1967, p. 162. In order to obtain rapid distribution of the reactants within the reaction vessel, specially constructed mixing devices can be employed, as illustrated by Audran U.S. Pat. No. 2,996,287, McCrossen et al. U.S. Pat. No. 3,342,605, Frame et al. U.S. Pat. No. 3,415,650, Porter et al. U.S. Pat. No. 3,785,777, Finnicum et al. U.S. Pat. No. 4,147,551, Verhille et al. U.S. Pat. No. 4,171,224, Calamur U.K. Patent Application No. 2,022,431A, Saito et al. German OLS Nos. 2,555,364 and 2,556,885, and Research Disclosure, Volume 166, February 1978, Item 16662.

In forming the nanoparticulate silver (carboxylate-n-alkyl thiolate) compound dispersions a surface modifier is initially contained in the reaction vessel. In a preferred form the surface modifier is comprised of an aqueous solution. Surface modifier concentrations of from 0.1 to about 30 percent by weight, based on the total weight of dispersion components in the reaction vessel, can be employed. It is common practice to maintain the concentration of the surface modifier in the reaction vessel in the range of below about 15 percent, based on the total weight, prior to and during silver carboxylate-silver thiolate compound combination formation. It is contemplated that the nanoparticulate silver carboxylate-silver thiolate compound combination dispersion as initially formed will contain from about 1 to 100 grams of surface modifier per mole of silver carboxylate preferably about 10 to 50 grams of surface modifier per mole of silver. Additional surface modifier can be added later to bring the concentration up to as high as 200 grams per mole of silver.

Vehicles (which include both binders and peptizers) can be employed. Preferred peptizers are hydrophilic colloids, which can be employed alone or in combination with hydrophobic materials. Suitable hydrophilic materials include substances such as proteins, protein derivatives, cellulose derivatives e.g., cellulose esters, gelatin e.g., alkali-treated gelatin (cattle bone or hide gelatin) or acid-treated gelatin (pigskin gelatin), gelatin derivatives e.g., acetylated gelatin, phthalated gelatin and the like, polysaccharides such as dextran, gum arabic, zein, casein, pectin, collagen derivatives, agaragar, arrowroot, albumin and the like as described in Yutzy et al. U.S. Pat. Nos. 2,614,928 and '929, Lowe et al., U.S. Pat. Nos. 2,691,582, 2,614,930, '931, 2,327,808 and 2,448,534, Gates et al. U.S. Pat. Nos. 2,787,545 and 2,956,880, Himmelmann et al. U.S. Pat. No. 3,061,436, Farrell et al. U.S. Pat. No. 2,816,027, Ryan U.S. Pat. Nos. 3,132,945, 3,138,461 and 3,186,846, Dersch et al. U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al. U.S. Pat. Nos. 2,992,213, 3,157,506, 3,184,312 and 3,539,353, Miller et al. U.S. Pat. No. 3,227,571, Boyer et al. U.S. Pat. No. 3,532,502, Malan U.S. Pat. No. 3,551,151, Lohmer et al. U.S. Pat. No. 4,018,609, Luciani et al. U.K. Pat. No. 1,186,790, Hori et al. U.K. Pat. No. 1,489,080 and Belgian Pat. No. 856,631, U.K. Pat. No. 1,490,644, U.K. Pat. No. 1,483,551, Arase et al. U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al. U.S. Pat. No. 2,725,293, Hilborn U.S. Pat. No. 2,748,022, DePauw et al. U.S. Pat. No 2,956,883, Ritchie U.K. Pat. No. 2,095, DeStubner U.S. Pat. No. 1,752,069, Sheppard et al. U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al. U.S. Pat. No. 3,923,517.

Photosensitive silver halide grains made using water dispersible cationic starch to control fog can also be used. The use of cationic starch in photothermographic elements is not our invention but is the invention of our coworkers, Maskasky, Dickinson and Lelental and is described U.S. Pat. No. 6,365,336.

Other materials commonly employed in combination with hydrophilic colloid peptizers as vehicles (including vehicle extenders—e.g., materials in the form of lattices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al. U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al. U.S. Pat. Nos. 2,484,456, 2,541,474 and 2,632,704, Perry et al. U.S. Pat. No. 3,425,836, Smith et al. U.S. Pat. Nos. 3,415,653 and 3,615,624, Smith U.S. Pat. No. 3,488,708, Whiteley et al. U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al. U.S. Pat. No. 3,879,205, Nottorf U.S. Pat. No. 3,142,568, Houck et al. U.S. Pat. Nos. 3,062,674 and 3,220,844, Dann et al. U.S. Pat. No. 2,882,161, Schupp U.S. Pat. No. 2,579,016, Weaver U.S. Pat. No. 2,829,053, Alles et al. U.S. Pat. No. 2,698,240, Priest et al. U.S. Pat. No. 3,003,879, Merrill et al. U.S. Pat. No. 3,419,397, Stonham U.S. Pat. No. 3,284,207, Lohmer et al. U.S. Pat. No. 3,167,430, Williams U.S. Pat. Nos. 2,957,767, Dawson et al. U.S. Pat. No. 2,893,867, Smith et al. U.S. Pat. Nos. 2,860,986 and 2,904,539, Ponticello et al. U.S. Pat. Nos. 3,929,482 and 3,860,428, Ponticello U.S. Pat. No. 3,939,130, Dykstra U.S. Pat. No. 3,411,911 and Dykstra et al. Canadian Pat. No. 774,054, Ream et al. U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al. U.S. Pat. Nos. 2,865,893 and 2,875,059, Rees et al. U.S. Pat. No. 3,536,491, Broadhead et al. U.K. Pat. No. 1,348,815, Taylor et al. U.S. Pat. No. 3,479,186, Merrill et al. U.S. Pat. No. 3,520,857, Bacon et al. U.S. Pat. No. 3,690,888, Bowman U.S. Pat. No. 3,748,143, Dickinson et al. U.K. Pat. Nos. 808,227 and '228, Wood U.K. Pat. No. 822,192 and Iguchi et al. U.K. Pat. No. 1,398,055. These additional materials need not be present in the reaction vessel during nanoparticulate silver carboxylate precipitation, but rather are conventionally added to the dispersion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

The nanoparticulate silver carboxylate-silver thiolate compound combination dispersions of the present invention are preferably free of soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing, as illustrated by Hewitson et al. U.S. Pat. No. 2,618,556, Yutzy et al. U.S. Pat. No. 2,614,928, Yackel U.S. Pat. No. 2,565,418, Hart et al. U.S. Pat. No. 3,241,969, Waller et al. U.S. Pat. No. 2,489,341, Klinger U.K. Pat. No. 1,305,409 and Dersch et al. U.K. Pat. No. 1,167,159; by centrifugation and decantation of a coagulated dispersion as illustrated by Murray U.S. Pat. No. 2,463,794, Ujihara et al. U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al. Soviet Chemical Industry, Vol. 6, No. 3, 1974, pp.181–185; by diafiltration with a semipermeable membrane, as illustrated by Research Disclosure, Vol. 102, October 1972, Item 10208, Hagemaier et al. Research Disclosure, Vol. 131, March 1975, Item 13122, Bonnet Research Disclosure, Vol. 135, July 1975, Item 13577, Berg et al. German OLS No. 2,436,461, Bolton U.S. Pat. No. 2,495,918, and Mignot U.S. Pat. No. 4,334,012, cited above, or by employing an ion exchange resin, as illustrated by Maley U.S. Pat. No. 3,782,953 and Noble U.S. Pat. No. 2,827,428.

In one aspect, there is provided an aqueous oxidation-reduction imaging forming composition comprising (i) a nanoparticulate dispersion of silver (carboxylate-n-alkyl thiolate) particles having on the surface of the particles a surface modifier which is a nonionic oligomeric surfactant based on vinyl polymer with an amido function and (ii) an organic reducing agent. Such a composition is useful, for example, in a thermographic element. An image can be formed in such an element by imagewise heating. Imagewise heating can be accomplished using an array of heating elements as the element is passed through a machine similar to a facsimile machine.

In another aspect, the compositions of the invention can be used in photothermographic elements wherein a photosensitive silver halide is present. Exposure of the silver halide produces a latent image that is then developed by a composition of the invention including nanoparticulate silver (carboxylate-n-alkyl thiolate) particles. An aqueous photothermographic composition according to the invention can be prepared by very thoroughly mixing (I) a hydrophilic photosensitive silver halide emulsion with (II) (a) a hydrophilic binder and (b) an oxidation-reduction image-forming composition comprising (i) an aqueous nanoparticulate dispersion of a silver carboxylate-silver thiolate compound combination with (ii) an organic reducing agent in water. A photothermographic element according to the invention can be prepared by coating the resulting photothermographic composition on a suitable support.

The aqueous photothermographic materials can comprise a photosensitive silver halide. The photosensitive silver halide is in the form of a hydrophilic photosensitive silver halide emulsion containing a gelatino peptizer. The photosensitive silver halide is especially useful due to its high degree of photosensitivity compared to other photosensitive components.

Spectral sensitization is the addition of compounds to silver halide grains which absorb radiation at wavelengths other than those to which silver halide is naturally sensitive (i.e., only within the UV to blue) or which absorb radiation more efficiently than silver halide (even within those natural regions of spectral sensitivity). It is generally recognized that spectral sensitizers extend the responses of photosensitive silver halide to longer wavelengths and can accomplish spectral sensitization the UV, visible or infrared regions of the electromagnetic spectrum. These compounds, after absorption of the radiation, transfer energy to the silver halide grains to cause the necessary local photoinduced reduction of silver salt to silver metal. The compounds are usually dyes, and the best method of spectrally sensitizing silver halide grains causes or allows the dyes to align themselves on the surface of the silver halide grain, particularly in a stacked, almost crystalline pattern on the surface of the individual grains.

Many cyanine and related dyes are well known for their ability to impart spectral sensitivity to a gelatino silver halide element. The wavelength of peak sensitivity is a function of the dye's wavelength of peak light absorbance. While many such dyes provide some spectral sensitization in photothermographic formulations, the dye sensitization is often very inefficient and it is not possible to translate the performance of a dye in gelatino silver halide elements to photothermographic elements. The emulsion making procedures and chemical environment of photothermographic elements are very harsh compared to those of gelatino silver halide elements. The presence of large surface areas of fatty acids and fatty acid salts as well as other components of photothermographic formulations restricts the surface deposition of sensitizing dyes onto silver halide surfaces and may remove sensitizing dye from the surface of the silver halide grains. The large variations in pressure, temperature, pH and solvency encountered in the preparation of photothermographic formulation aggravate the problem. Thus sensitizing dyes that perform well in gelatino silver halide elements are often inefficient in photo-thermographic formulations. In general, it has been found that merocyanine dyes are superior to cyanine dyes in photothermographic formulations as disclosed, for example, in British Patent No 1,325,312 and U.S. Pat. No. 3,719,495. Recently, certain cyanine dyes have been disclosed as spectral sensitizers for use in photothermographic elements. For example, U.S. Pat. Nos. 5,441,866 and 5,541,054 describe photothermographic elements spectrally sensitized with benzothiazole heptamethine dyes substituted with various groups, including alkoxy and thioalkyl. Although spectral sensitizing dyes for photothermographic elements are now known which absorb through-out the visible and near-infrared regions (i.e., 400–850 nm) photothermographic emulsions which provide higher photographic speeds and which have improved shelf-life stability, sensitivity, contrast and low Dmin are still needed for photothermography. U.S. Pat. No. 4,207,108 (Hiller) describes improved speed in photothermographic materials by addition of a photographic speed increasing concentration of a certain non-dye, thione speed increasing addendum (including compounds with cyclic thiocarbonyl [>COS] groups within the cyclic structure). No decomposition of the cyclic thione compounds is reported. U.S. Pat. No. 5,541,055 (Ooi et al.) describes photothermographic elements that comprise both a cyanine dye and a colorless cyclic carbonyl compound. Rhodanine, hydantoin, barbituric acid, or derivatives thereof (all shown to be monocyclic in columns 4–6) are particularly preferred as the colorless cyclic carbonyl compound. The recent commercial availability of relatively high powered semiconductor light sources, and particularly laser diodes which emit in the red and near-infrared region of the electromagnetic spectrum, as sources for out-put of electronically stored image data onto photosensitive film or paper is becoming increasingly wide spread. This has led to a need for high quality imaging articles, which are sensitive at these wavelengths, and has created a need for more highly sensitive photothermographic elements to match such exposure sources both in wavelength and intensity.

To get the speed of the photothermographic elements up to maximum levels and further enhance sensitivity, it is often desirable to use supersensitizers. Any supersensitizer can be used which increases the sensitivity. For example, preferred infrared supersensitizers are described in U.S. patent application Ser. No. 08/091,000 (filed Jul. 13, 1993) and include heteroaromatic mercapto compounds or heteroaromatic disulfide compounds of the formulae: Ar—S—M and Ar—S—S—Ar, wherein M represents a hydrogen atom or an alkali metal atom. In the above noted supersensitizers, Ar represents a heteroaromatic ring or fused heteroaromatic ring containing one or more of nitrogen, sulfur, oxygen, selenium or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline or quinazolinone. However, other heteroaromatic rings are envisioned under the breadth of this invention. The heteroaromatic ring may also carry substituents with examples of preferred substituents being selected from the group consisting of halogen (e.g., Br and Cl), hydroxy, amino, carboxy, alkyl (e.g., of 1 or more carbon atoms, preferably 1 to 4 carbon atoms) and alkoxy (e.g., of 1 or more carbon atoms, preferably of 1 to 4 carbon atoms. Most preferred supersensitizers are 2-mercaptobenzimidazole, 2-mercapto-5-methylbenzimidazole (MMBI), 2-mercaptobenzothiazole, and 2-mercaptobenzoxazole (MBO). The supersensitizers are used in general amount of at least 0.001 moles of sensitizer per mole of silver in the emulsion layer. Usually the range is between 0.001 and 1.0 moles of the compound per mole of silver and preferably between 0.01 and 0.3 moles of compound per mole of silver.

A typical concentration of hydrophilic photosensitive silver halide emulsion containing a gelatino peptizer and the imaging forming composition according to the invention is within the range of about 0.02 to about 1.0 mole of photosensitive silver halide per mole of the described silver (carboxylate-n-alkyl thiolate) particles in the photothermographic material. Other photosensitive materials can be useful in combination with the described photosensitive silver halide if desired. Preferred photosensitive silver halides are silver chloride, silver bromoiodide, silver bromide, silver chlorobromoiodide or mixtures thereof. For purposes of the invention, silver iodide is also considered to be a photosensitive silver halide. A range of grain size and grain morphology of photosensitive silver halide from very coarse grain to very fine grain and from 3D to tabular silver halide is useful. Tabular grain photosensitive silver halide is useful, as described in, for example, U.S. Pat. No. 4,435,499. Very fine grain silver halide is typically preferred.

The hydrophilic photosensitive silver halide emulsion containing a gelatino peptizer can be prepared by any of the procedures known in the photographic art which involve the preparation of photographic silver halide gelatino emulsion. Useful procedures and forms of photosensitive silver halide gelatino emulsions for purposes of the invention are described in, for example, the Product Licensing Index, Volume 92, December 1971, Publication 9232 on page 107, published by Industrial Opportunities Limited, Homewell, Havant Hampshire, P09 1EF, UK. The photographic silver halide, as described, can be washed or unwashed, can be chemically sensitized using chemical sensitization procedures. Materials known in the photographic art can be protected against the production of fog and stabilized against loss of sensitivity during keeping as described in the mentioned Product Licensing Index publication.

A hydrophilic photosensitive silver halide emulsion containing a gelatino peptizer that contains a low concentration of gelatin is often very useful. The concentration of gelatin that is very useful is typically within the range of about 9 to about 25 grams per mole of silver. (The term "hydrophilic" is intended herein to mean that the photosensitive silver halide emulsion containing a gelatino peptizer is compatible with an aqueous solvent.)

The gelatino peptizer that is useful with the photosensitive silver halide emulsion can comprise a variety of gelatino peptizers known in the photographic art. The gelatino peptizer can be, for example, phthalated gelatin or non-phthalated gelatin. Other gelatino peptizers that are useful include acid or base hydrolyzed gelatins. A non-pbthalated gelatin peptizer is especially useful with the described photosensitive silver halide emulsion.

The photosensitive silver halide emulsion can contain a range of concentration of the gelatino peptizer. Typically, the concentration of the gelatino peptizer is within the range of about 5 grams to about 40 grams of gelatino peptizer, such as gelatin, per mole of silver in the silver halide emulsion. This is described herein as a low-gel silver halide emulsion. An especially useful concentration of gelatino peptizer is within the range of about 9 to about 25 grams of gelatino peptizer per mole of silver in the silver halide emulsion. The optimum concentration of the gelatino peptizer will depend upon such factors as the particular photosensitive silver halide, the desired image, the particular components of the photothermographic composition, coating conditions and the like.

Typically, the silver halide emulsion pH is maintained within the range of about 5.0 to about 6.2 during the emulsion precipitation step. Lower pH values may cause undesired coagulation and higher pH values may cause undesirable grain growth.

The temperature of the reaction vessel within which the silver halide emulsion is prepared is typically maintained within a temperature range of about 35° C. to about 75° C. during the composition preparation. The temperature range and duration of the preparation can be altered to produce the desired emulsion grain size and desired composition properties. The silver halide emulsion can be prepared by means of emulsion preparation techniques and apparatus known in the photographic art.

An especially useful method for preparation of the photothermographic composition is by a simultaneous double-jet emulsion addition of the component silver nitrate and halide salts into a jacket enclosing an ultrasonic means for exposing the composition to high frequency waves. After combination in the jacket and thorough mixing due to the ultrasonic waves, the mixture can be withdrawn and recirculated through the jacket enclosing the ultrasonic means for additional mixing or withdrawn immediately and combined readily with other addenda to produce the desired photothermographic composition.

A variety of hydrophilic binders are useful in the described photothermographic materials. The binders that are useful include various colloids alone or in combination as vehicles and/or binding agents. The hydrophilic binders which are suitable include transparent or translucent materials and include both naturally occurring substances, such as proteins, gelatin, gelatin derivatives, cellulose derivatives, polysaccharides, such as dextrin, gum arabic and the like and synthetic polymeric substances such as water-soluble polyvinyl compounds like polyvinyl alcohol, poly(vinyl pyrrolidone), acrylamide polymers and the like. Other synthetic polymeric compounds, which can be employed, include dispersed vinyl compounds such as latex form and particularly those that increase dimensional stability of photographic materials. A range of concentration of hydrophilic binder can be useful in the photothermographic silver halide materials according to the invention. Typically, the concentration of hydrophilic binder in a photothermographic silver halide composition according to the invention is within the range of about 0.5 to about 10 g/m$^2$. An optimum concentration of the described binder can vary depending upon such factors as the particular binder, other components of the photothermographic material, coating conditions, desired image, processing temperature and conditions and the like.

If desired, a portion of the photographic silver halide in the photothermographic composition according to the invention can be prepared in situ in the photothermographic material. The photothermographic composition, for example, can contain a portion of the photographic silver halide that is prepared in or on one or more of the other components of the described photothermographic material rather than prepared separate from the described components and then admixed with them. Such a method of preparing silver halide in situ is described in, for example, U.S. Pat. No. 3,457,075 of Morgan et al., issued Jul. 22, 1969.

The described photothermographic composition comprises an oxidation-reduction image-forming combination containing a silver carboxylate-silver thiolate compound combination, with a suitable reducing agent. The oxidation-reduction reaction resulting from this combination upon heating is believed to be catalyzed by the latent image silver from the photosensitive silver halide produced upon image-wise exposure of the photothermographic material followed by overall heating of the photothermographic material. The exact mechanism of image formation is not fully understood.

A variety of organic reducing agents are useful in the described photothermographic silver halide materials according to the invention. These are typically silver halide developing agents that produce the desired oxidation-reduction image-forming reaction upon exposure and heating of the described photothermographic silver halide material. Examples of useful reducing agents include: polyhydroxybenzenes, such as hydroquinone and alkyl substituted hydroquinones; catechols and pyrogallol; phenylenediamine developing agents; aminophenol developing agents; ascorbic acid developing agents, such as ascorbic acid and ascorbic acid ketals and other ascorbic acid derivatives; hydroxylamine developing agents; 3-pyrazolidone developing agents such as 1-phenyl-3-pyrazolidone and 4-methyl-4-hydroxymethyl-1-phenyl-3-pyrazolidone; hydroxytetronic acid and hydroxytetronamide developing agents; reductone developing agents; bis-naphthol reducing agents; sulfonamidophenol reducing agents: hindered phenol reducing agents and the like. Combinations of organic reducing agents can be useful in the described photothermographic silver halide materials. Sulfonamidophenol developing agents, such as described in Belgian Pat. No. 802,519 issued Jan. 18, 1974 can be especially useful in the photothermographic silver halide composition.

A range of concentration of the organic reducing agent can be useful in the described photothermographic silver halide materials. The concentration of organic reducing agent is typically within the range of about 0.5 g/m$^2$ to about 5 g/m$^2$, such as within the range of about 0.8 to about 3.0 g/m$^2$. The optimum concentration of organic reducing agent will depend upon such factors as the particular carboxylate, e.g. long-chain fatty acid, the desired image, processing conditions, the particular solvent mixture, coating conditions and the like.

The order of addition of the described components for preparing the photothermographic composition before coating the composition onto a suitable support is important to obtain optimum photographic speed, contrast and maximum density.

A variety of mixing devices is useful for preparing the described compositions. However, the mixing device should be one that provides very thorough mixing. Mixing devices that are useful are commercially available colloid mill mixers and dispersator mixers known in the photographic art.

Photothermographic materials according to the invention can contain other addenda that are useful in imaging. Suitable addenda in the described photothermographic materials include development modifiers that function as speed-increasing compounds, hardeners, antistatic layers, plasticizers and lubricants, coating aids, brighteners, spectral sensitizing dyes, antifoggants, charge control agents, absorbing and filter dyes, matting agents and the like.

The specific addenda depend on the exact nature of the imaging element. The present invention is useful for forming laser output media useful for reproducing x-ray images; it is useful for forming microfilm elements and it is useful to form graphic arts elements. Each of these applications has well known features requiring specialized addenda known in the respective arts for these elements.

As noted, the present invention provides a nanoparticulate silver (carboxylate-n-alkyl thiolate) compositions. An important advantage of these compositions is that they can be coated from an aqueous environment. Several current elements of this type are currently coated from organic solvents. The present invention can be used to convert these products into aqueous coated products. In this process, some of the components typically found in these elements might not be as soluble in water as desired. These components also can be made into nanoparticulate dispersions using the same or compatible surface modifiers as are described.

A photothermographic element according to the invention can have a transparent protective layer comprising a film forming binder, preferable a hydrophilic film forming binder. Such binders include, for example, crosslinked polyvinyl alcohol, gelatin, poly(silicic acid), and the like. Particularly preferred are binders comprising poly(silicic acid) alone or in combination with a water-soluble hydroxyl-containing monomer or polymer as described in the U.S. Pat. No. 4,828,971.

The term "protective layer" is used to mean a transparent, image insensitive layer that can be an overcoat layer, that is a layer that overlies the image sensitive layer(s). The protective layer can also be a backing layer, that is, a layer that is on the opposite side of the support from the image sensitive layer(s). The imaging element can contain an adhesive interlayer or adhesion promoting interlayer between the protective layer and the underlying layer(s). The protective layer is not necessarily the outermost layer of the imaging element.

The protective layer can contain an electrically conductive layer having a surface resistivity of less than $5\times10^{11}$ ohms/square. Such electrically conductive overcoat layers are described, for example, in U.S. Pat. No. 5,547,821.

A photothermographic imaging element can include at least one transparent protective layer containing matte particles. Either organic or inorganic matte particles can be used. Examples of organic matte particles are beads of polymers such as polymeric esters of acrylic and methacrylic acid, e.g., poly(methylmethacrylate), styrene polymers and copolymers, and the like. Examples of inorganic matte particles are glass, silicon dioxide, titanium dioxide, magnesium oxide, aluminum oxide, barium sulfate, calcium carbonate, and the like. Matte particles and the way they are used are further described in U.S. Pat. Nos. 3,411,907, 3,754,924, 4,855,219, 5,279,934, 5,288,598, 5,378,577, 5,563,226 and 5,750,328.

A wide variety of materials can be used to prepare the protective backing layer that is compatible with the requirements of photothermographic elements. The protective layer should be transparent and should not adversely affect sensitometric characteristics of the photothermographic element such as minimum density, maximum density and photographic speed. Useful protective layers include those comprised of poly(silicic acid) and a water-soluble hydroxyl containing monomer or polymer that is compatible with poly(silicic acid) as described in U.S. Pat. No. 4,741,992 and 4,828,971, the entire disclosures of which are incorporated herein by reference. A combination of poly(silicic acid) and poly(vinyl alcohol) is particularly useful. Other useful protective layers include those formed from polymethylmethacrylate, acrylamide polymers, cellulose acetate, crosslinked polyvinyl alcohol, terpolymers of acrylonitrile, vinylidene chloride, and 2-(methacryloyloxy) ethyl-trimethylammonium methosulfate, crosslinked gelatin, polyesters and polyurethanes.

Particularly preferred protective layers are described in above-mentioned U.S. Pat. Nos. 5,310,640 and 5,547,821.

The photothermographic elements according to the invention can comprise a variety of supports that can tolerate the processing temperatures useful in developing an image. Typical supports include cellulose ester, poly(vinyl acetal), poly(ethylene terephthalate), polycarbonate and polyester film supports. Related film and resinous support materials, as well as paper, glass, metal and the like supports that can withstand the described processing temperatures are also useful. Typically a flexible support is most useful.

Coating procedures known in the photographic art can coat the photothermographic compositions on a suitable support. Useful methods including dip coating, air-knife coating, bead coating using hoppers, curtains coating or extrusion coating using hoppers. If desired, two or more layers can be coated simultaneously.

The described silver halide and oxidation-reduction image-forming combination can be in any suitable location in the photothermographic element according to the invention which produces the desired image. In some cases it can be desirable to include certain percentages of the described reducing agent, the silver salt oxidizing agent and/or other addenda in a protective layer or overcoat layer over the layer containing the other components of the element as described. The components, however, must be in a location that enables their desired interaction upon processing.

It is necessary that the photosensitive silver halide, as described and other components of the imaging combination are "in reactive association" with each other in order to produce the desired image. The term "in reactive association," as employed herein, is intended to mean that the photosensitive silver halide and the image-forming combination are in a location with respect to each other, which enables the desired processing and produces a useful image.

A useful embodiment of the invention is a photothermographic silver halide composition capable of being coated on a support. The composition comprises (a) an aqueous photosensitive silver halide emulsion containing a gelatin peptizer with (b) a hydrophilic polymeric binder consisting essentially of a gelatin and (c) an oxidation-reduction image-forming combination comprising (i) an aqueous, nanoparticulate, silver (carboxylate-n-alkyl thiolate) composition consisting essentially of silver (behenate-n-alkyl thioloate) particles and a surface modifier as described (ii) an organic reducing agent consisting essentially of a hindered phenol. This composition can be coated on a suitable support to produce a photothermographic element according to the invention. Another embodiment of the invention is a method of preparing a photothermographic element comprising coating the resulting composition onto a suitable support to produce a photothermographic element as desired.

Elements of the invention can be imaged using a variety of methods. The elements can be imaged using any suitable source of radiation to which the photothermographic material is sensitive. The imaging materials according to the invention are typically sensitive to the ultraviolet and blue regions of the spectrum and exposure sources that provide this radiation are preferred.

Typically, however, if a spectral sensitizing dye (or combination of spectral sensitizing dyes) is present in the photothermographic material, exposure using other ranges of the electromagnetic spectrum can be useful. Typically, a photothermographic material according to the invention is exposed imagewise with a visible light source, such as a tungsten lamp or laser or an infrared light source, such as a laser or a light emitting diode (LED). Other sources of radiation can be useful and include, for instance, electron beams, X-ray sources and the like. The photothermographic materials are typically exposed imagewise to produce a developable latent image.

A visible image can be developed in the photothermographic material according to the invention within a short time, such as within several seconds, merely by heating the photothermographic material to moderately elevated temperatures. For example, the exposed photothermographic material can be heated to a temperature within the range of about 100° C. to about 200° C., such as a temperature within the range of about 110° C. to about 140° C. Heating is carried out until a desired image is developed, typically within about 2 to about 60 seconds, such as 8 to 30 seconds. Selection of an optimum processing time and temperature will depend upon such factors as the desired image, particular components of the photothermographic element, the particular latent image and the like.

The necessary heating of the described photothermographic material to develop the desired image can be accomplished in a variety of ways. Heating can be accomplished using a simple hot plate, iron, roller, infrared heater, hot air or the like.

Processing according to the invention is typically carried out under ambient conditions of pressure and humidity. Pressures and humidity outside normal atmospheric conditions can be useful if desired; however, normal atmospheric conditions are preferred.

EXAMPLES

Example 1

Procedure for Precipitation of Nanoparticulate Silver (Behenate-1-dodecanethiol)

Raw Materials

Demineralized water
Nominally 90% Behenic Acid (Unichema) recrystallized from isopropanol to purify
Dodecylthiopolyacrylamide (Surfactant)
12.77%(w/w) aqueous silver nitrate
10.81% (w/w) aqueous potassium hydroxide
1-dodecanethiol A 20 gallon reactor was charged with 31.5 kg of water, 135g surfactant, 4.05 g 1-dodecanethiol and 925.6 g of behenic acid. The contents were stirred at 150 RPM with a retreat curve stirrer and heated to 70° C. Once the mixture reached 70° C., 1243.6 g of 10.81% aqueous potassium hydroxide were added to the reactor. The mixture was heated to 80° C. and held there for 30 minutes. The mixture was then cooled to 70° C. When the reactor reached 70° C., 3125 g of 12.77% aqueous silver nitrate were fed to the reactor in 5 minutes. After the addition, the nanoparticulate silver behenate was held at the reaction temperature for 30 minutes. It was then cooled to room temperature and filtered. A silver behenate dispersion with a median particle size of 160 nm was obtained.

Procedure for Purifying and Concentrating Nanoparticulate Silver (Behenate-1-dodecanethiol) Dispersions 37.5 kg of 3% solids nanoparticulate silver (behenate-1-dodecanethiol) dispersion described above were loaded into the hopper of a diafiltration/ultrafiltration apparatus. The permeator membrane cartridge was an Osmonics model 23-20k-PS-S8J which has an effective surface area of 13 square feet and a nominal molecular weight cutoff of 20,000. The permeate was replaced with deionized water until 112 kg of permeate had been removed from the dispersion. At this point, the replacement water was turned off and the apparatus was run until the dispersion had been concentrated to 28% solids. The yield was 3200 grams.

Comparative Examples 1 and 2

Nanoparticulate silver (behenate) prepared as in Invention Example 1 except no thiol was added to the dispersion. Different batches of dispersing aid were used and these results indicate the batch-to-batch variability of the surfactant preparation.

Comparative Example 3

Nanoparticulate silver (behenate) prepared as in Comparative Example 2 except 1.35 grams of 1-dodecanethiol were added after the precipitation and purification steps.

Comparative Example 4

Nanoparticulate silver (behenate) prepared as in Comparative Examples 2 except 4.05 grams of 1-dodecanethiol were added after the precipitation and purification steps.

Comparative Example 5

Nanoparticulate silver (behenate) prepared as in Comparative Examples 2 except 13.5 grams of 1-dodecanethiol were added after the precipitation and purification steps.

Comparative Example 6

Nanoparticulate silver (behenate) prepared as in Invention Example 1 except 4.05 grams of tertiary dodecanethiol were added with the reagents.

Invention Example 2

Nanoparticulate silver (behenate-n-alkyl thiolate) prepared as in Invention Example 1 except 4.05 grams of 1-hexanethiol were used instead of 1-dodecanethiol.

Invention Example 3

Nanoparticulate silver (behenate-n-alkyl thiolate) prepared as in Invention Example 1 except 4.05 grams of 1-octadecanethiol were used instead of 1-dodecanethiol.

Invention Example 4

Nanoparticulate silver (behenate-n-alkyl thiolate) prepared as in Invention Example 1 except 1.3 5 grams of 1-dodecanethiol were used.

Invention Example 5

Nanoparticulate silver (behenate-n-alkyl thiolate) prepared as in Invention Example 1 except 13.5 grams of 1-dodecanethiol were used.

Invention Example 6

Aqueous Photothermographic Imaging Elements Formulated Using Nanoparticulate Silver (behenate-n-alkyl thiolate) Dispersions The photosensitive emulsion layer was prepared by combining 155.7 grams of 7.1% aqueous solution of polyvinyl alcohol (PVA, Elvanol 52–22 86–89% hydrolyzed (DuPont)) with 122.02 grams of an aqueous nanoparticulate silver (behenate-n-alkyl thiolate) dispersions prepared as described in Invention Examples 1 through 5 and comparative exampes. To this mixture was added 10.32 grams of solid particle dispersion of AF-1, described below, 5.44 grams of a 25 g/l aqueous solution of AF-2, also described below, 2.72 grams of succinimide toner and 6.61 grams of 50 g/l aqueous solution of sodium iodide. The mixture was stirred overnight. A primitive iodobromide cubic emulsion, Br97%I3%, 48 nanometer in edge length and containing 20 g/silver mole gelatin was melted at 40° C. and then spectrally sensitized by combining 15.43 grams of emulsion 0.760 kg/mol with 10.11 grams of a 3 g/l aqueous solution of D-1, described below, followed by addition of 1.64 grams of a 7 g/l methanolic solution of D-2, also described below.

The silver behenate mixture described above was combined with 21.04 grams of spectrally sensitized emulsion. This mixture was combined with 24.5 grams of a solid particle dispersion of developer Dev-1, described below. The solid particle dispersion of the developer had been prepared by milling a 20% solution of Dev-1, with 1.6% PVP and 0.8% SDS in water. The solid particle dispersion of AF-1 had been prepared by milling a 20% solution of AF-2 with 2.0% of Triton® X-200 (Rohm and Haas, Philadelphia Pa.) in water.

A thermally processable imaging element was prepared by coating a gelatin subbed poly(ethylene terephthalate) support, having a thickness of 0.178 mm, with a photothermographic imaging layer and a protective overcoat. The layers of the thermally processable imaging element were coated on a support by coating procedures known in the photographic art, in this example using an extrusion coating hopper. The photothermographic imaging composition was coated from aqueous solution at a wet coverage of 97.8 g/m$^2$ to form an imaging layer of the following dry composition:

TABLE 1

Photothermographic Imaging Layer dry coverage

| Components | Dry Coverage (g/m$^2$) |
|---|---|
| Succinimide | 0.761 |
| Dev-1 | 1.367 |
| Emulsion cubic edge 0.048 micron silver level | 0.472 |
| D-1 | 0.00652 |

TABLE 1-continued

| Photothermographic Imaging Layer dry coverage | |
|---|---|
| Components | Dry Coverage ($g/m^2$) |
| D-2 | 0.00196 |
| Silver behenate | 7.652 |
| Polyvinyl Alcohol (PVA, Elvanol 52–22 from DuPont 86–89% hydrolyzed) | 3.260 |
| Sodium Iodide, USP | 0.092 |
| AF-1 | 0.577 |
| AF-2 | 0.038 |

The resulting imaging layer was then overcoated with mixture of polyvinyl alcohol and hydrolyzed tetraethyl orthosilicate as described in Table 2 at a wet coverage of 40.4 $cc/m^2$ and dry coverage shown in Table 3.

TABLE 2

| Overcoat Solution | |
|---|---|
| Component | Grams |
| Distilled Water | 1158.85 grams |
| Polyvinyl Alcohol (PVA, Elvanol 52–22 from DuPont, 86–89% hydrolyzed) (6.2% by weight in distilled water) | 763.43 |
| Tetraethyl Orthosilicate solution comprising of 178.5 grams of water 1.363 grams of p-Toluene Sulfonic Acid, 199.816 grams of Methanol, 207.808 grams of Tetraethyl Orthosilicate | 489.6 |
| Aerosol OT (0.15% by weight in distilled water. (Aereosol OT is a sodium bis-2-ethylhexyl sulfosuccinate surfactant and is available from the Cytec Industries, Inc.., U.S.A.) | 75.00 |
| Zonyl FSN (0.05% by weight in distilled water. (Zonyl FSN ® surfactant is a mixture of fluoro-alkyl poly(ethyleneoxide) alcohols and is a trademark of and available from the Dupont Corp., U.S.A.) | 3.13 |
| Silica (1.5 micron) | 3.0 |

TABLE 3

| Overcoat layer dry coverage | |
|---|---|
| PSA (Silicate) | 1.302 |
| PVA | 0.872 |
| Aerosol OT | 0.0624 |
| Zonyl FSN ® | 0.0207 |

The imaging element of Example 6 was exposed using the 810 nm, laser sensitometer and heat processed at 122 C. for 15 sec to produce a developed silver image.

Structures of components described above in the Aqueous Photothermographic Imaging Element.

D-1

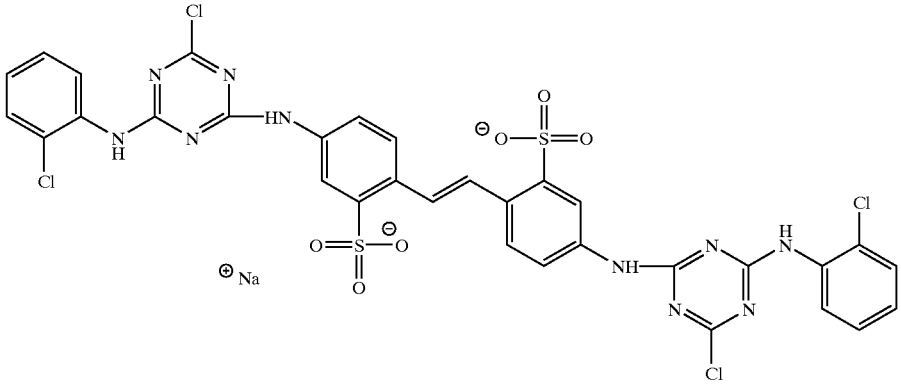

D-2

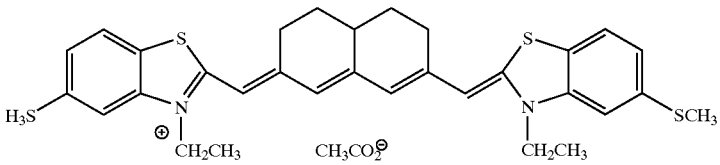

AF-1

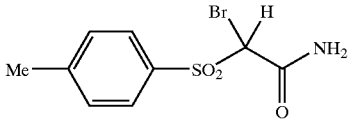

AF-1

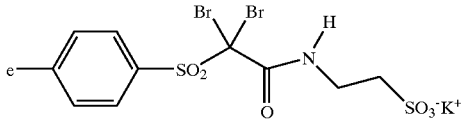

-continued

Developer Dev-1

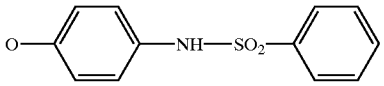

PVP

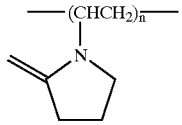

SDS $H_3(CH_2)_{11}$—$SO_4^-Na^+$

TABLE 5

Sensitometry data for Invention and Comparative Examples

| Dispersion | Surfactant Batch | Fresh D-min | Fresh D-max | Kept D-min |
|---|---|---|---|---|
| Invention 1 | 1 | 0.090 | 3.38 | 0.112 |
| Invention 2 | 1 | 0.083 | 2.98 | 0.122 |
| Invention 3 | 1 | 0.102 | 3.27 | 0.112 |
| Invention 4 | 2 | 0.111 | 2.94 | 0.140 |
| Invention 5 | 1 | 0.081 | 3.40 | 0.090 |
| Comparative 1 | 1 | 0.288 | 2.53 | 0.365 |
| Comparative 2 | 2 | 0.163 | 2.87 | 0.340 |
| Comparative 3 | 1 | 0.225 | 2.63 | 0.341 |
| Comparative 4 | 1 | 0.214 | 2.80 | 0.313 |
| Comparative 5 | 1 | 0.204 | 2.80 | 0.273 |
| Comparative 6 | 1 | 3.609 | 3.609 | 3.84 |

Discussion of Examples

Comparative Examples 1 and 2, neither of which contain n-alkylthiolate, are replicate syntheses that use different batches of the same dispersant. The variability in the D-min and consistently unacceptable kept D-mins demonstrate the need for this invention.

Invention Examples 1, 2, and 3 demonstrate that the inclusion of linear thiols in the invention provide consistently low fresh and kept D-min's (0.083–0.122) while Comparative Example 1 has poor fresh and kept D-mins (0.288 and 0.365 respectively).

Comparative Example 2 had significantly lower fresh D-min than Comparative Example 1(0.163 versus 0.288), but the fresh D-min is not as low as Invention Example 4 (0.111). After keeping the D-min increases to 0.340 for Comparative Example 2 while Invention Example 4 has a D-min of 0.14.

The benefit of adding the thiol prior to precipitation is demonstrated in Invention Example 4 versus Comparative Example 3, Invention Example 1 versus Comparative Example 4, and Invention Example 5 versus Comparative Example 5. The fresh and kept D-mins range from 0.081 to 0.14 for the invention example while the fresh and kept D-mins range from 0.204 to 0.341 for the comparison examples. When Comparative Examples 3 through 5 are compared with Comparative Example 1, there is an improvement in fresh D-min from 0.288 to 0.204 to 0.225, but any improvement is almost entirely lost after keeping. The addition of thiol after the silver behenate precipitation has the additional disadvantage of generating dispersion having the characteristic rotten egg smell of thiols.

Comparative Example 6 demonstrates that non linear thiols (outside the scope of the present invention) do not provide the same advantages as do linear alkyl thiols. The thiol used to prepare the dispersion of Comparative Example 6 is an isomer (a tertiary alkyl thiolate) of the thiol used in Invention Examples 1, 4, and 5; yet its use causes very high fog.

What is claimed is:

1. An aqueous photothermographic composition comprising a) a spectrally sensitized photosensitive silver halide emulsion containing a gelatino peptizer and b) an oxidation-reduction imaging forming composition comprising (i) a dispersion of silver (carboxylate-n-alkyl thiolate) particles having on the surface of the particles a surface modifier which is a nonionic oligomeric surfactant based on a vinyl polymer with an amido function and (ii) an organic reducing agent.

2. The aqueous photothermographic composition according to claim 1 wherein said particles further include carboxylic acid in an amount from about 0.01 to 20% by weight relative to the silver carboxylate.

3. The aqueous photothermographic composition according to claim 1 wherein said particles are nanoparticulate.

4. The aqueous photothermographic composition according to claim 1 wherein said dispersion is aqueous and said particles are stabilized by having on their surface a surface modifier that is a nonionic oligomeric surfactant based on vinyl polymers with an amido function.

5. The aqueous photothermographic composition according to claim 1 wherein said silver salt is a salt of a long chain fatty acid containing 8 to 30 carbon atoms.

6. The aqueous photothermographic composition according to claim 1 wherein said silver carboxylate is silver behenate.

7. The aqueous photothermographic composition according to claim 1 wherein said n-alkyl thiolate is 1-dodecanethiol.

8. A photothermographic element comprising a support having thereon a layer comprising the aqueous photothermographic composition according to claim 1.

9. An aqueous photothermographic composition comprising a) an infrared spectrally sensitized photosensitive silver halide emulsion containing a gelatino peptizer and b) an oxidation-reduction imaging forming composition comprising (i) a dispersion of silver (carboxylate-n-alkyl thiolate) particles having on the surface of the particles a surface modifier which is a nonionic oligomeric surfactant based on a vinyl polymer with an amido function and (ii) an organic reducing agent.

10. The aqueous photothermographic composition according to claim 9 wherein said particles further include carboxylic acid in an amount from about 0.01 to 20% by weight relative to the silver carboxylate.

11. The aqueous photothermographic composition according to claim 9 wherein said particles are nanoparticulate.

12. The aqueous photothermographic composition according to claim 9 wherein said dispersion is aqueous and said particles are stabilized by having on their surface a surface modifier that is a nonionic oligomeric surfactant based on vinyl polymers with an amido function.

13. The aqueous photothermographic composition according to claim 9 wherein said silver salt is a salt of a long chain fatty acid containing 8 to 30 carbon atoms.

14. The aqueous photothermographic composition according to claim 9 wherein said silver carboxylate is silver behenate.

15. The aqueous photothermographic composition according to claim 9 wherein said n-alkyl thiolate is 1-dodecanethiol.

16. A photothermographic element comprising a support having thereon a layer comprising the aqueous photothermographic composition according to claim 9.

* * * * *